US006481035B2

(12) United States Patent
Seagar et al.

(10) Patent No.: US 6,481,035 B2
(45) Date of Patent: Nov. 19, 2002

(54) TOP LOADING WASHING MACHINE

(75) Inventors: Neville David Seagar, Auckland (NZ); Gordon Sharpe Hunter, Auckland (NZ)

(73) Assignee: Fisher & Paykel Limited, Auckland (NZ)

( * ) Notice: Subject to any disclaimer, the term of this patent is extended or adjusted under 35 U.S.C. 154(b) by 0 days.

(21) Appl. No.: 10/006,468

(22) Filed: Dec. 6, 2001

(65) Prior Publication Data

US 2002/0040506 A1 Apr. 11, 2002

Related U.S. Application Data

(62) Division of application No. 09/436,414, filed on Nov. 9, 1999, now Pat. No. 6,343,492.

(30) Foreign Application Priority Data

Nov. 9, 1998 (NZ) ..... 332708
Jun. 2, 1999 (NZ) ..... 336088

(51) Int. Cl.[7] ..... D06F 37/28
(52) U.S. Cl. ..... 8/159; 68/139; 68/142
(58) Field of Search ..... 8/159; 68/139, 68/140, 142, 144, 196

(56) References Cited

U.S. PATENT DOCUMENTS

| | | | |
|---|---|---|---|
| 1,105,174 A | 7/1914 | Bartholomew | |
| 1,472,434 A | 10/1923 | Oberg | |
| 2,291,463 A | 7/1942 | Gerlach | |
| 2,579,761 A | 12/1951 | Schmidtke | |
| 3,280,603 A | 10/1966 | Schwamm | |
| 3,553,982 A | 1/1971 | Berry et al. | |
| 5,678,430 A | 10/1997 | Merlin et al. | |

FOREIGN PATENT DOCUMENTS

| | | | | |
|---|---|---|---|---|
| DE | 2631750 | * | 1/1977 | ..... 68/139 |
| EP | 361775 | | 4/1990 | |
| EP | 0483909 | | 6/1992 | |
| FR | 2291308 | | 6/1976 | |
| FR | 2478151 | | 9/1981 | |
| JP | 274294 | * | 4/1989 | ..... 68/139 |

* cited by examiner

*Primary Examiner*—Philip Coe
(74) *Attorney, Agent, or Firm*—Trexler, Bushell, Giangiorgi, Blackstone & Marr, Ltd.

(57) ABSTRACT

A method of operating a horizontal axis laundry machine through a drum opening operation is provided. The laundry machine includes a cabinet and a drum mounted in the cabinet. The drum has a drum skin including a cover section and a remainder. An edge of the cover section is connected to an edge of the remainder by an interengaging latch member. The method includes the steps of rotating the drum until the drum skin is in a first set position relative to the cabinet, engaging the cover section to retain the position thereof relative to the cabinet while engaged, sliding the latch member to release the cover section edge from the remaining drum section edge, rotating the drum to a second set position with the cover section engaged to leave an opening into the drum, and allowing opening of the cabinet to provide access to the opening.

6 Claims, 10 Drawing Sheets

TOP LOADING WASHING MACHINE

This is a divisional of application Ser. No. 09/436,414, filed Nov. 9, 1999, and now U.S. Pat. No. 6,343,492.

BACKGROUND TO THE INVENTION

1. Field of the Invention

This invention relates to laundry washing machines and in particular to laundry washing machines which include a horizontal load enclosing drum where access to the drum is provided through the side thereof 2. Description of the Prior Art It is well known that horizontal axis laundry washing machines have a lower water use in their standard operating mode than vertical axis washing machines in their standard operating mode. It is also well known that there are significant ergonomic advantages with a washing machine which is loaded from above Attempts have been made to provide access to horizontal access laundry machine drums using a hatch in the top face of a cabinet, and a corresponding hatch access through the drum of the machine. Machines of this type are well known for the difficulty to the user in revolving the fully laden drum to a position where the two hatches are in registration and due to the hazardous nature of the generally spring loaded hatch opening in the drum. Furthermore the provision of a hatch in the drum results in a significant reduction in the strength of the drum and a consequent reduction in the ultimate spin speed which can be safely achieved. A lower spin speed leaves more liquid in the clothes load and consequently increases the drying time, and if using a clothes dryer, power consumption.

SUMMARY OF THE INVENTION

It is therefore an object of the present invention to provide a laundry machine and/or a drum for a laundry machine and/or associated methods of operation of a laundry machine which goes some way towards overcoming the above disadvantages or will at least provide the public with a usefull choice.

In a first aspect the invention may broadly be said to include a method of operating a horizontal axis laundry machine through a drum opening operation, the laundry machine including a cabinet, a drum mounted in the cabinet and having a drum skin comprising a cover section and a remainder, an edge of the cover section connected to an edge of the remainder by an interengaging latch member, the method comprising rotating the drum until the drum skin is in a first set position relative to the cabinet, engaging a cover section of the drum skin to retain the position thereof relative to the cabinet while engaged, sliding the latch member to release the cover section edge from the remaining drum section edge rotating the drum to a second set position with the cover section engaged to leave an opening into the drum, and allowing opening of the cabinet to provide access to the opening.

In a second aspect the invention may broadly be said to include a method of operating a horizontal axis laundry machine including a cabinet, a drum mounted in the cabinet (and a hingingly supported laundry guide flap), the drum having a drum skin comprising a cover section and a remainder, the method including the steps of:

rotating the drum until the drum skin is in a first set position relative to the cabinet, engaging a cover section of the drum skin to retain the position thereof relative to the cabinet while engaged, rotating the drum to a second set position with the cover section engaged to leave an opening into the drum, hinging the laundry guide flap to a position inhibiting access between the drum and the cabinet adjacent the opening, and allowing opening of the cabinet to provide access to the opening.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DETAILED DESCRIPTION

Figure 1:
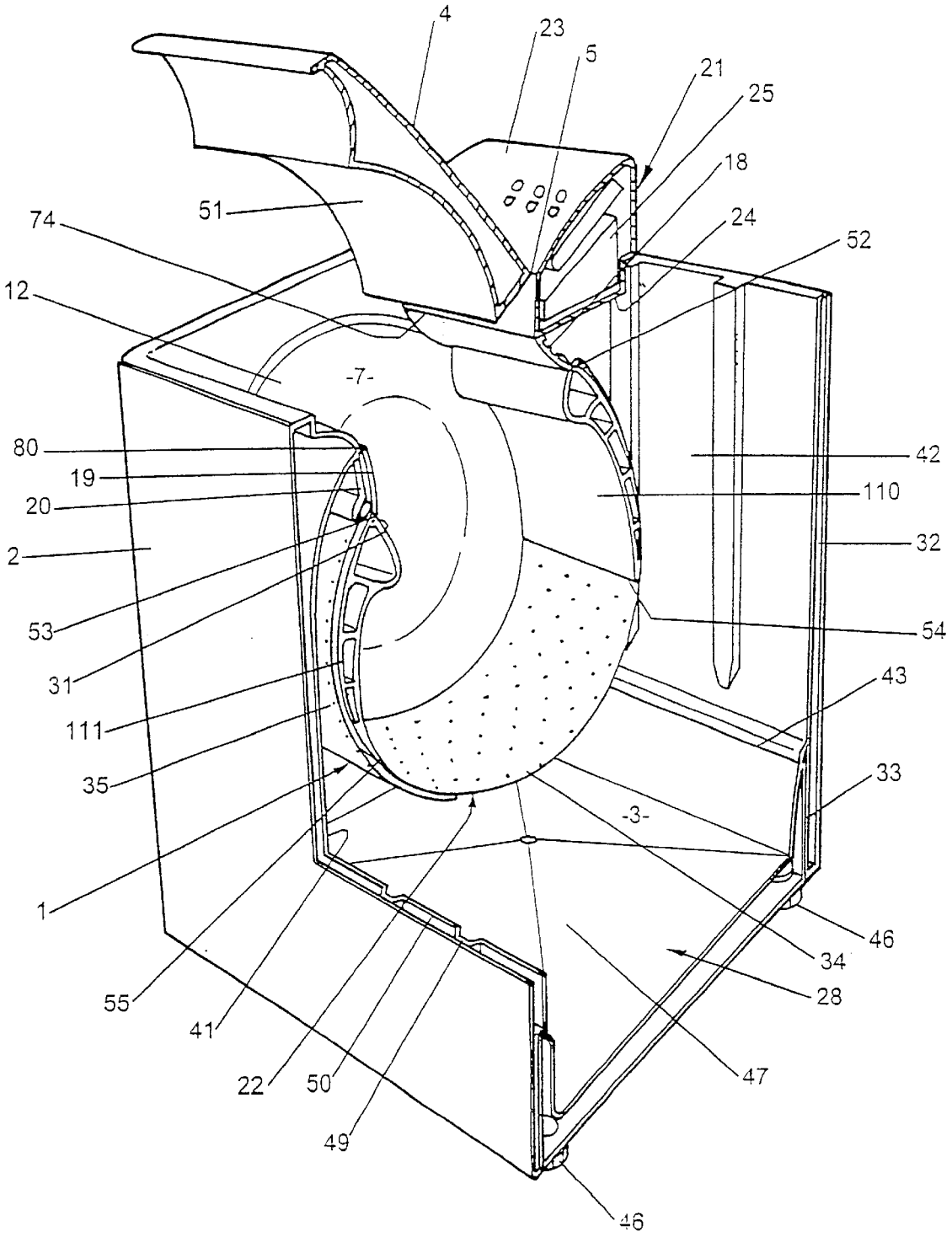
FIG. 1 is a cutaway perspective view of a washing machine according to the present invention with the cutaway to show a substantial part of the machine in cross section.
Figure 2:
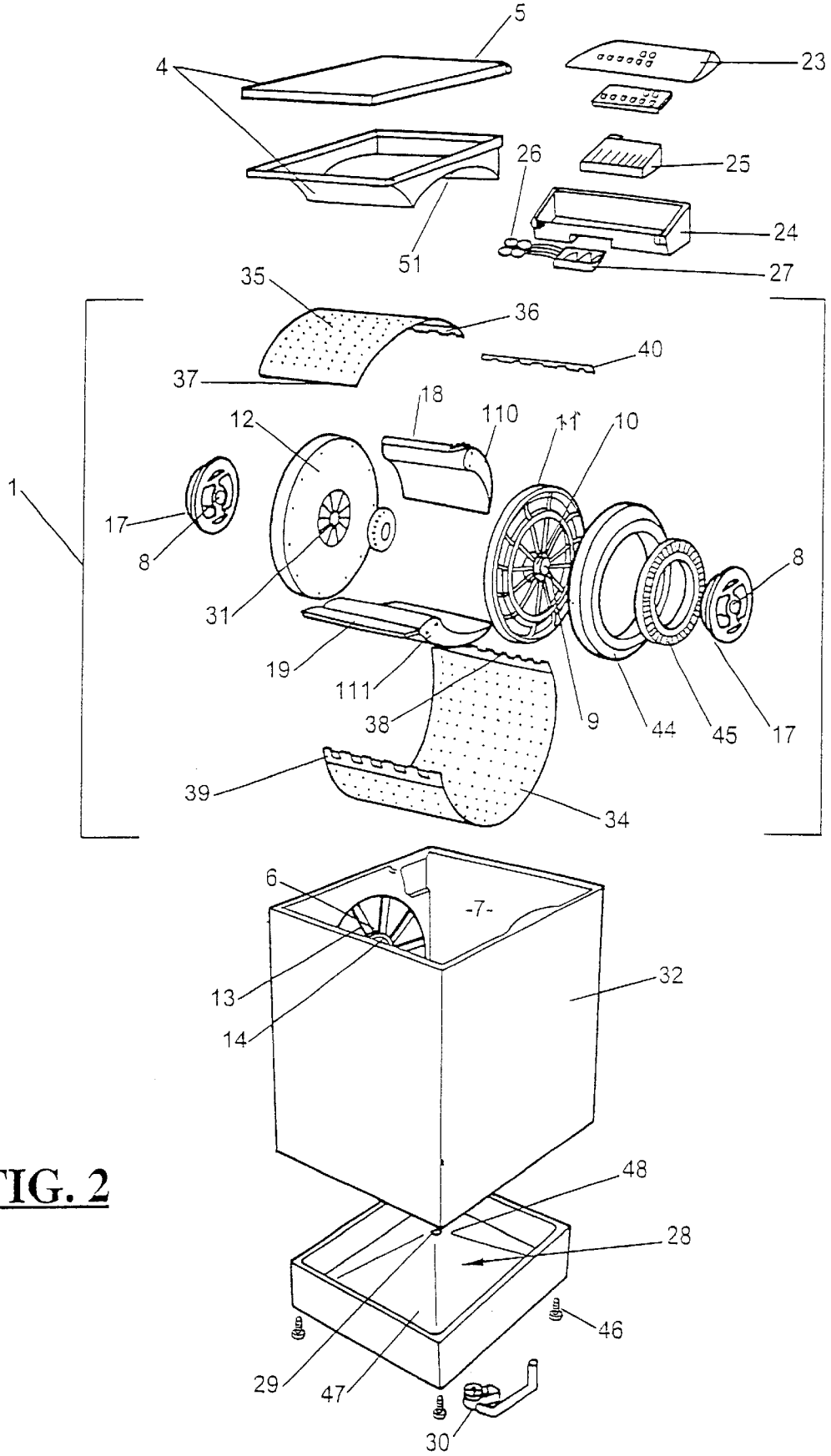
FIG. 2 is an exploded view of the washing machine of FIG. 1 showing the various major pars that go together to form the machine.

FIGS. 1 and 2 show a washing machine of the horizontal axis type, having a perforated drum 1 supported with its axis substantially horizontal in side-to-side (eastwest) orientation within a cabinet 2. The cabinet 2 includes surfaces which confine wash or rinse liquid leaving the drum within a water tight enclosure 3. Some parts of the cabinet structure 2 may be formed together with the liquid confining surfaces by for example twin-sheet thermoforming.

The machine is a top-loading machine, and includes a lid 4 hinged from its back edge 5 which encloses a top opening 7 through which a user accesses the drum 1 and loads and unloads the machine.

The drum 1 is rotatably supported by bearings 8 at either end which in turn are each supported by a drum support (6 and not visible) fitted to the side walls of the machine. In the embodiment depicted the bearings are axially located, externally, on a shaft means 9 protruding from the hub area 10 of each of a pair of drum ends 11,12. Other axial configurations are equally possible, for example internally located in a well in the outer face of the hub area of the drum to be located on a shaft protruding from the drum support. Each drum support preferably includes a strengthening rib area 13 and a drum accommodating well area 14 to accommodate the respective drum end of the drum 1. The drum supports may be made, for example, by thermoforming, injection molding or blow molding from plastics materials. The drum supports 6 (and not shown) are engaged with the cabinet by interlocking within complementary surfaces provided in side walls. Other less preferable constructions are possible, such as frameworks formed from individual members or mechanical suspension systems.

The drum supports each include a bearing support well at the centre of the well area 14. A flexible, but very stiff, bearing mount 17 is located within the bearing support well, and in turn the bearing 8 fits within a boss in the bearing mount 17.

The drum includes a two-part skin and a pair of drum ends 11, 12 connected by a pair of laterally extending vanes 110, 111. The main part 34 of the drum skin is secured at each of its ends 38, 39 (circumferential ends) to the vanes 110, 111. Each lateral edge 16 of the main section of sldn resides over an annular ledge (not shown) on the respective drum end the remainder 35 of the drum skin, which spans between the ends 38, 39 of the main part 34 of the drum sldn, and therefor between the vanes 110, 111 of the drum, is a hatch section. The hatch section 35 slides back in use to reveal an opening into the drum. Each of the lateral edges 15 of the hatch section travel within inwardly facing annular channels (not shown) formed on the inward face of the respective drum ends 11, 12, at least along the sector of the drum ends spanning between the vanes 110,111. When the hatch section 35 is closed it is connected to the main section 34 along each of the respective meeting edges to form a substantially continuous hoop. The connection along one edge 36, 38 is by an active latch. The connection along the other edge 37, 39 is a passive connection.

Laundry load guiding flaps 18, 19 are provided along the edge of each vane 110, 111 adjacent the drum opening, and with the drum open they hide the space between the drum and the cabinet from the user and guide the laundry load into the drum These flaps also act as scrapers/guides when the drum is opened or closed.

A further flap 20 is provided to engage the hatch section 35 of the drum so that the drum may be opened by rotating the remainder of the drum 1, having the effect of sliding open the hatch 35 while the hatch remains in its fixed location.

The washing machine includes an electric motor (rotor 44 and stator 45 visible in FIG. 2) to effect rotation of the drum during all phases of operation (wash, rise and spin dry). In the preferred form of the washing machine incorporating the present invention the motor is a direct drive inside-out electronically commutated brushless dc motor having a permanent magnet rotor 44 coupled to one end 11 of the drum 1 and stator 45 coupled to the drum support (not visible). A suitable form of motor is described in EP0361775. It will be appreciated that motors of this type give the ability to accurately control the position of the motor (and thus the drum) from the energisation thereof. Other type motors would also be useable, for example a more standard DC or AC motor driving rotation of the drum through a belt and having a position detector (such as a rotary shaft encoder) to determine and monitor the drum position.

Operation of the machine is controlled by a central microprocessor, which controls the water valves, pump and the motor in accordance with programs residing within its memory, with user settings at a macro level and indications from the various motor loads, at a micro level. Physically the microprocessor is preferably located in an isolated and environment-proofed compartment 21. This environment proof compartment includes an upper control console 23 and a lower tray 24 enclosing the electronics module 25 there between. It is mounted at the upper end of the back side of the washing machine. This places it in close proximity with many of the items that it connects to. User settings are preferably made on a control pad, which is part of the control console 23 together with a corresponding display.

Water inlet valves 26, and a detergent dispenser 27, are provided immediately below, and connected to the bottom of the outside of the compartment 21. The water inlet valves 26 introduce water to the operating enclosure 3 through the detergent dispenser 27. A plurality of valves, or a diverter valve, may be provided if it is required that the detergent dispenser dispense more than one detergent type.

In use liquid exiting the drum 1 through the perforations in the wall 22 thereof drains down the front or rear wall portions of the operating enclosure 3 and collects in the tray 28. The tray 28 includes an outlet sump 29 to which water within the tray 28 drains. A pump 30 is connected to the outlet 29, in the preferred embodiment being located directly below the outlet 29, to operate at the direction of the control processor.

In the preferred form of machine incorporating the present invention the wash liquid is passed to drum 1, through inlets 31 disposed in one or both of the drum ends 11, 12. In the preferred form liquid is supplied to only one of the two drum ends, preferably drum end 12 which does not have the motor associated therewith. The shaft extending from each drum end, and over which the drum supporting bearing is fitted, preferably has a bore there through. Pressurised wash liquid is supplied to the drum through this bore.

Cabinet

In FIGS. 1 and 2 the cabinet as shown has a water receiving tray 28 which fits inside the lower end of a substantially rectangular wrapper 32. The tray 28 is secured within the lower end 33 of the rectangular wrapper by any suitable means, but the connection there between is preferably substantially water tight, at least to liquids flowing down the inside surfaces (eg front surface 41 and rear surface 42) of the wrapper. To that end the two may for example be secured by plastic welding at their abutting edges, or an annular seal or labyrinth seal may be provided at the joint 43.

The tray 28 preferably includes the feet 46 of the machine on which the machine rests on an appropriate surface. The particular embodiment described herein is particularly suited to use on very stiff floors, for example concrete floors, and furthermore it would be recommended that the machine be secured to the floor to restrain it from movement due to out-of-balance loads.

The upper surface 47 of the water receiving tray 28 is formed so that liquid flows to collect at a low point 48 thereof, which low point is provided with a receiving sump or drain 29. A pump assembly 30 is connected to the underside of the tray 28 directly below the drain 29, receiving water therefrom and pumping it selectively to either the wash liquid inlet to the drum 31 or to the waste wash liquids outlet from the machine at the instigation of the washing machine controller.

The rectangular wrapper 32 may be formed by twin sheet thermoforming, with all four walls being formed as a single contiguous panel and then folded at the joints between wall sections to form the four sided wrapper, with the folded joints forming the corners of the wrapper. The inside face of the folded panel then forms the liquid confining surfaces of at least the four side walls of the enclosure 3, while the outside face of the folded panel forms the outer faces of the machine. In the twin sheet thermoforming process these walls can be formed from different materials to suite their needs, the outside for example being chosen for aesthetic appeal, and the inside sheet for moisture barrier properties. The sheets may be formed together to be joined at various regions to reinforce the structure (eg vertical regions 49 forming ribs 50). The water receiving tray 28 may also be formed by twin sheet thermoforming.

The lid 4 is provided, hinged at its rear edge 5, to enclose the open upper end 7 of the wrapper 32. The lid preferably includes a protruding inner surface 51 which substantially matches the shape of the drum 1. One of the laundry guiding flaps passes across this surface during the opening and closing operation as will be described further on A latch is provided which can selectively lock the lid in the closed position. The lock may be activated by an electrical linear actuator controlled by the control microprocessor.

The Drum

In the present invention as depicted in FIGS. 1 and 2 the drum 1 comprises, in more detail, a perforated metal hoop 22, the pair of ends 11,12 enclosing the ends of the hoop 22 to form a substantially cylindrical chamber, and a pair of vanes 110, 111 extending between the drum ends 11, 12.

In the preferred form of the invention the drum is driven only from one end 11 and consequently one purpose of the vanes 110, 111 is to transmit rotational torque to the non-driven drum end 12. The vanes also provide longitudinal rigidity to the drum assembly 1. To these ends the vanes 110, 111 are wide and shallow, although they have sufficient depth and internal reinforcing to achieve any required resistance to buckling due to unbalanced dynamic loads. Preferably the vanes 110, 111 have a distinct form, including a leading edge 52, 53 (respectively) and trailing edge 54, 55 (respectively) to assist in tumbling the washing load. In the preferred embodiment the vanes 110, 111 are oriented oppositely in a rotational direction, so that under rotation in either direction one vane (110,111) is going forwards and the other (111 or 110) backwards. This vane configuration provides further benefits in providing a user friendly opening into the washing chamber as is described below.

To give access to the inside of the drum 1 the perforated metal hoop 22 is divided circumferentially into two pieces, a main drum section 34 and a hoop completing hatch section 35. In FIG. 1 the hatch section 35 is shown in its disconnected and withdrawn mode, with the machine open. In the preferred form of the invention, the hatch section 35 extends the full width of the metal hoop 22. The hatch section 35 connects along opposed edges 36,37 thereof to the two free edges 38,39 of the main drum section 34. The hatch section 35 is connected in such a way hat it is fully secured to each edge of the main drum section 34 against tensile circumferential forces (hoop stresses). Therefore, under a spin cycle of the washing machine, with the drum 1 rotating at up to 1000 RPM or more, the drum skin 22 is a fully connected and continuous hoop, which is optimal for handling the hoop stresses generated in the drum skin. If the connections between the edges 36, 37 of the hatch section 35 and the edges 38, 39 of the main drum section 34 are sufficiently strong themselves, and distribute the load across the entire width of the drum skin 22, then the loads on the drum skin 22 will be as if the drum skin 22 were entirely continuous. The hoop stresses caused by the high speed rotation of the drum are therefor not concentrated by a hatch opening passing through the drum and being effectively not load bearing as they are in the prior art.

In the preferred embodiment of the invention the hatch section 35 is connected along one edge 36 by an active mechanical latching mechanism which interconnects it with the respective free edge 38 of the main drum section 34. The preferred form of mechanism is described below with reference to FIGS. 4A and 4B. The other edge 37 of the hatch section 35 may be connected to its corresponding edge 39 of the drum main section 34 in a number of broadly different forms depending for example on the manner in which the hatch section 35 is intended to open. In the preferred form of the invention as depicted, the batch section 35 is intended to slide open and a passive connection is made along this edge. This passive connection is described below with reference to FIGS. 5A and 5B.

Active Latch

Figure 4A:
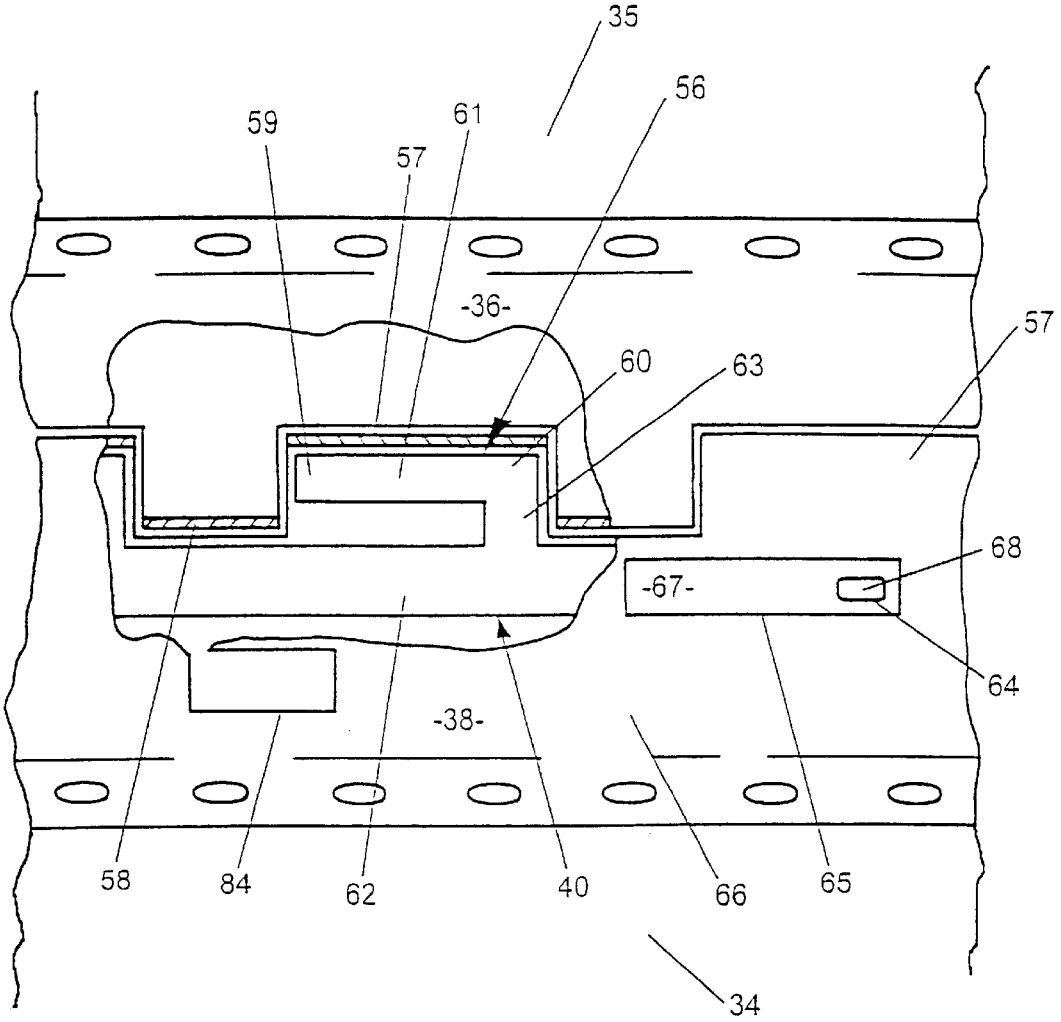
FIGS. 4A and 4B are close up plan views, with partial cutaway of an area of the drum skin where the hatch part meets the main part showing in detail the latching mechanism associated with one edge of the hatch opening and the operation thereof.
Figure 4B:
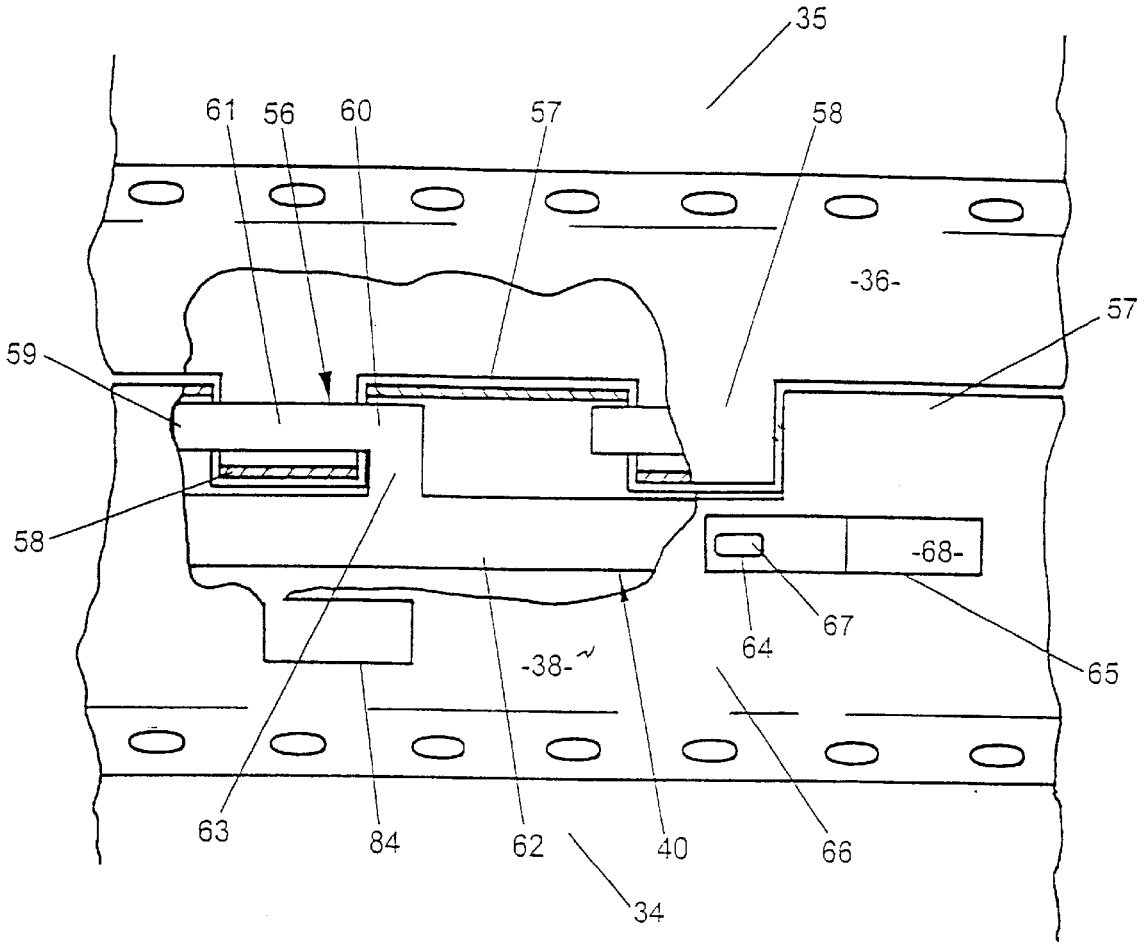

Referring to FIGS. 4A and 4B the preferred latching mechanism comprises a sliding bar 40 with a series of hook latches 56 extending therefrom. The entire sliding bar 40, including hook latches 56, is retained inside the loops 57 of the looped over edge 38 of the drum main section 34. The series of hook latches 56 is adapted to be engageable through a series of complimentary loops 58 extending from the corresponding edge 36 of the cover section 35 upon lateral movement of the sliding bar 40. The loops 58 of the cover section 35 are interleaved with the loops 57 of the main section 34, and, in a latched position as shown in FIG. 4B each of the hooks 56 of the sliding bar 40 extend through the loops 58 of the cover section 35 so that they each are retained at both ends 59, 60 within adjacent loops 57 of the main section 34 and the corresponding loop 58 of the cover section 35 is around the portion 61 of the hook 56 that spans the gap between the two adjacent loops 57 of the main section 34. Thus the hooks 56 act as hinge pins between the interleaved loops 57,8 and are acted upon almost entirely under shear. The "pin" part (59–61) of each hook is connected to the main sliding bar 62 by a yoke 63 at one end 60.

The sliding bar 40 is slidable between a "closed" position, as in FIG. 4B where the hooks 56 span the respective gaps between loops 57 of the drum section edge 38, and an "open" position, as in FIG. 4A where the hooks 56 are retained entirely within respective loops 57 of the drum main section edge 38, and do not encroach on the gaps there between. With the sliding bar in the "open" position the loops 58 of the edge 36 of the cover section 35 are free to pass into or out of the gaps between loops 57 of the drum main section 34, for engagement or disengagement respectively. Operation of the sliding bar 40 is affected by slidably moving a button 64 protruding from the sliding bar 40 through an elongate window 65 through he folded over section 66 of the main section edge 38. The button 64 is slidable from one position 67 to another 68 to move the sliding bar 40 between the closed position and the open position and vice-a-versa as appropriate. Actuation of the button 64 is preferably achieved automatically, and may be, for example, by a rotating wheel (not shown) located in the main housing of the machine, having one or more cog teeth extending from the circumference thereof such that rotation of the wheel, when the sliding bar button is in an appropriate position, forces one of the teeth to push the sliding bar button from one position to another.

In the above it will be readily seen that the engagement does not rely on the latch member 40 being in particular in the looped over edge of the drum main section 34. The arrangement could as easily be reversed so that the latch member 40 was retained in the looped over edge of the hatch section 35.

Passive Connection

Figure 5A:
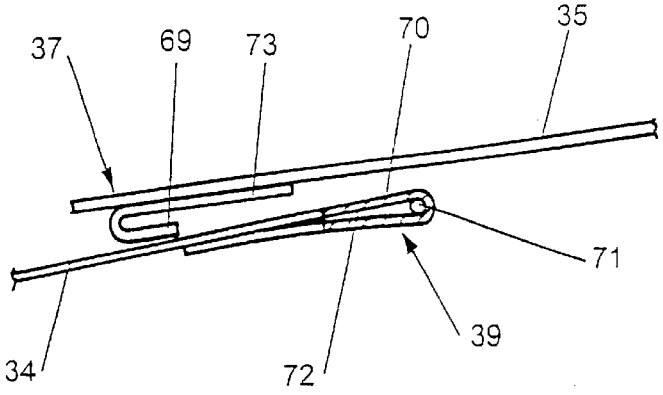
FIGS. 5A and 5B are cross sectional side elevations of a part of the drum skin where the hatch meets the main part, showing in detail the securing mechanism associated with the other edge of the hatch opening then that in FIGS. 4A and 4B and the operation thereof.
Figure 5B:
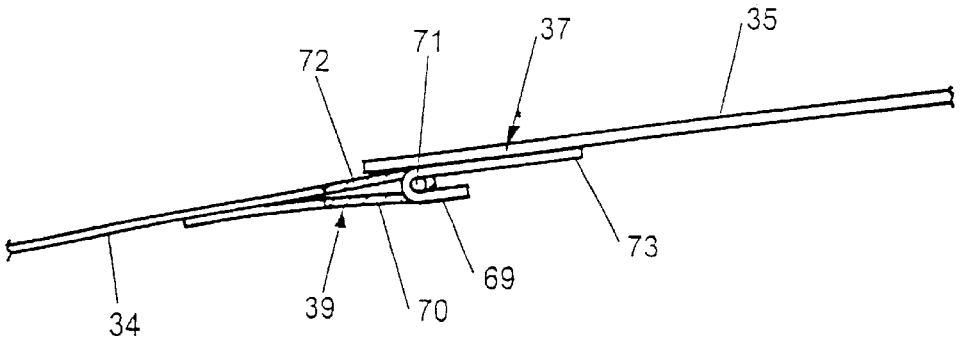

Referring to FIGS. 5A and 5B the trailing edge 37 of the sliding hatch section 35 is preferably engaged passively with the corresponding edge 39 of the drum main section 34. In the preferred form as shown, one of the two edges (we have chosen the hatch section edge 37) carries a series of spaced apart hooks 69. The other edge 39 carries a series of loops 70 which in turn retain an elongate rod 71 which extends the entire width of the edge 39. This effectively creates a lateral series of openings 72 into which the spaced apart hooks 69 of the hatch section 35 pass as the hatch section 35 slides closed relative to the man section 34. The hooks 69 then engage over the rod 71 where the rod 71 spans between loops 70 of the main section edge 39. This arrangement is shown in non-engaged and engaged modes in FIGS. 5A and 5B respectively. The spaced apart hooks 69 could be formed directly in the trailing edge 37 of the hatch section 35, however they come under considerable load due to the hoop stresses, and consequently it is preferred that they be formed from substantially stronger material than that of the hatch section 35, for example sheet material being 4–5 times thicker than the drum skin. They may extend from the trailing edge of a hook retaining member 73 extending the width of the hatch section 35 and being welded to the hatch section 35 over the entire width thereof, or at least sufficiently secured to transfer the load to/from the hatch section 35 without introducing stress concentrations.

Once again it will be readily appreciated that the arrangement of the hooks/rod could be easily reversed. Furthermore other methods of connection (including active engagement methods) could be used, the method presently described merely being a preferred method due to its simplicity and strength.

Laundry Guiding Flaps

In the preferred form of the invention as shown in FIGS. 1 and 2 the laundry guiding flaps include a first flap 18 connected to the edge 52 of the vane 110 which is adjacent and forms the rear edge of the drum opening when the drum 1 is in its open condition. This first flap 18 extends from the edge 52 of the vane 110 and meets the lower front edge 74 of the electronics enclosing console module 21. The flap 18 is hingeably connected to the vane 110 and is sprung to bias it outward. The spring (not shown) may for example take the form of a wire torsion spring. The hinged connection may be accomplished in any known manner, for example by having a hinge pin passing through a series of interleaved loops formed in the respective parts. The first flap 18 preferably includes a series of reinforcing ribs 75 on the back thereof so that it can withstand the pressure of clothes bearing against it during the spin cycle of the washing machine. The edge 76 of the flap that rests against the console module 21 with the machine open, preferably includes a rearwardly extending foot 77. This foot 77 will slide along the inside surface 57 of the lid 4 of the cabinet during closure, such that the flap 18 may guide any excess wash load away from the lid and into the drum. As closure is completed the foot 77 will pass down a face 78 of the hatch engaging flap 20 and allow the first flap 18 to tuck within the drum skin 22.

A second flap 19 is hingably connected to the edge 53 of the vane 111 which is adjacent and forms the front edge of the opening into the drum 1. This flap 19 extends from the vane 111 to have its far end 79 resting against the front edge 80 of the cabinet opening when the drum is open. It is hingably connected to the vane 111, and provided with a spring to bias it to the outward position. During closure of the drum the flap 19 is tucked downward by the relative movement of the hatch section 35. During opening of the drum the leading edge 79 of the flap 19 scrapes over the inside face 81 of the hatch 35 by the relative movement there between, and peels any damp laundry which may be adhered to the hatch section 35 of the drum skin 22 from the surface thereof to fall within the body of the drum.

Hatch Engaging Lever

To open and close the drum automatically the hatch section 35 of the drum is engaged by a flap or lever. In the preferred embodiment of the invention this is essentially a third flap 20. This third flap 20 is hinged from the inside of the cabinet 2, and is actively controlled, for example by an electric linear actuator (not shown). The flap 20 has a leading face 78 that extends (when the flap is in its engaged position) from very close to the front edge 80 of the cabinet opening to just ahead of the leading (looped over) edge 36 of the hatch section 35 of the drum skin 22. The lap 20 then has a backwardly extending portion 82 which extends back along the outside of the looped over part 86 of the hatch section 35 and, at a position beyond the loops 58 by which the hatch section 35 engages with the main section 34 in the active latching, has a series of protrusions 83 spaced along the width thereof. These protrusions 83 engage within a series of correspondingly located openings 84 in the upper web 85 of the hatch section 35 at the looped over section 86 thereof. The protrusions 83 and openings 84 are formed so that when the flap 20 is engaged with the hatch section 35, the hatch section 35 is held from movement in either direction of rotation of the drum 1. The flap 20 is operable, by operation of the linear actuator, to engage or disengage with the hatch section 35, between a first engaged condition as described above, and a second, disengaged, position where it is entirely clear of the path of the hatch section 35 and of the remainder of the drum 1 (during rotation thereof).

Operation of the Machine

In use the washing operation begins with the delivery to the interior of the drum 1 of a load of washing to be washed. Before a user is allowed access to the interior of the machine (by opening the lid 4) the drum 1 is opened. When the user opens the lid 4 they are presented with an opening directly into the drum 1, with the spaces 87 between the drum 1 and the cabinet 2 being shielded from view (and from accidental clothes entry), by the flaps 18,19. This configuration (with the lid 4 open) is shown in FIG. 1.

The user deposits their laundry load in the machine, adds detergents to the detergent dispenser 27, and closes the lid 4. The user then proceeds to select an appropriate wash cycle by pressing the corresponding button on the console 23, and instructs the machine to start operation by pressing a "start" button.

With the lid 4 closed, the wash cycle selected and the machine instructed to start, the microprocessor then proceeds to lock the lid 4 and close and latch the drum skin 22. Closure of the drum 1 is described in detail below with reference to FIGS. 3E to 3I. The machine then proceeds through the wash cycle. At this point the wash, rinse and spin cycles occur in series. These will not be described as any number of known regimes of water transfer and drum action may be used.

When the wash cycle has finished the machine indicates that it has completed the washing operation. At this point the damp laundry have probably adhered to the inside surface of the drum sldn 22 due to the high speed spin operation. The machine opens the drum in anticipation that the user will require access to remove the laundry load. In opening the drum the machine peels the clothes away from the surface 81 of the hatch section 35 of the drum skin 22. Once the drum is fully open the flaps 18 and 19 are in position hiding the spaces 87 between drum 1 and cabinet 2 from view. The drum opening operation is described in detail below with reference to FIGS. 3A to 3E. The lid 4 is then unlocked so that the user can access the machine to remove the laundered load.

It will be appreciated of course that a user may desire to access the laundry load during a wash cycle. In that case the lid 4 remains locked until the drum has come to rest and the drum opening operations have taken place. In the present embodiment of the invention the clothes are washed using recirculation of the washing liquid, which drains freely from the drum 1, and the machine is of toploading configuration, so there is no need for liquid draining operations before access is provided.

Opening the Drum

Figure 3B:
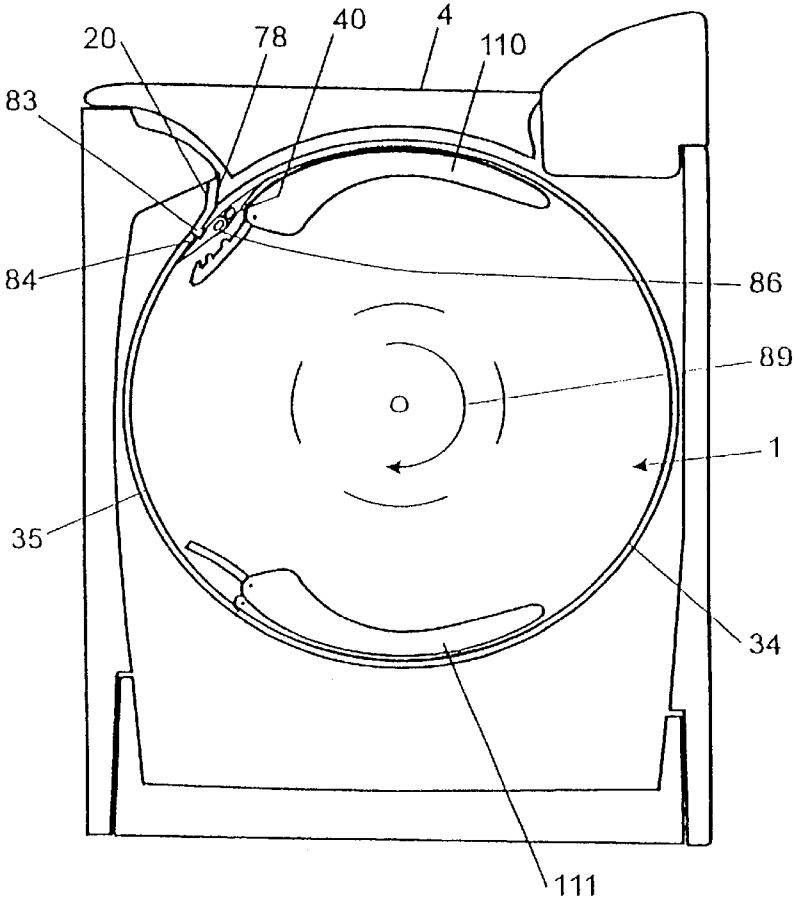
FIGS. 3A to 3I are a series of cross sectional side elevations in simplified form, depicting the sequence of operations in opening and closing the drum of the washing machine of the present invention, and the functioning of the parts involved in those operations.
Figure 3A:
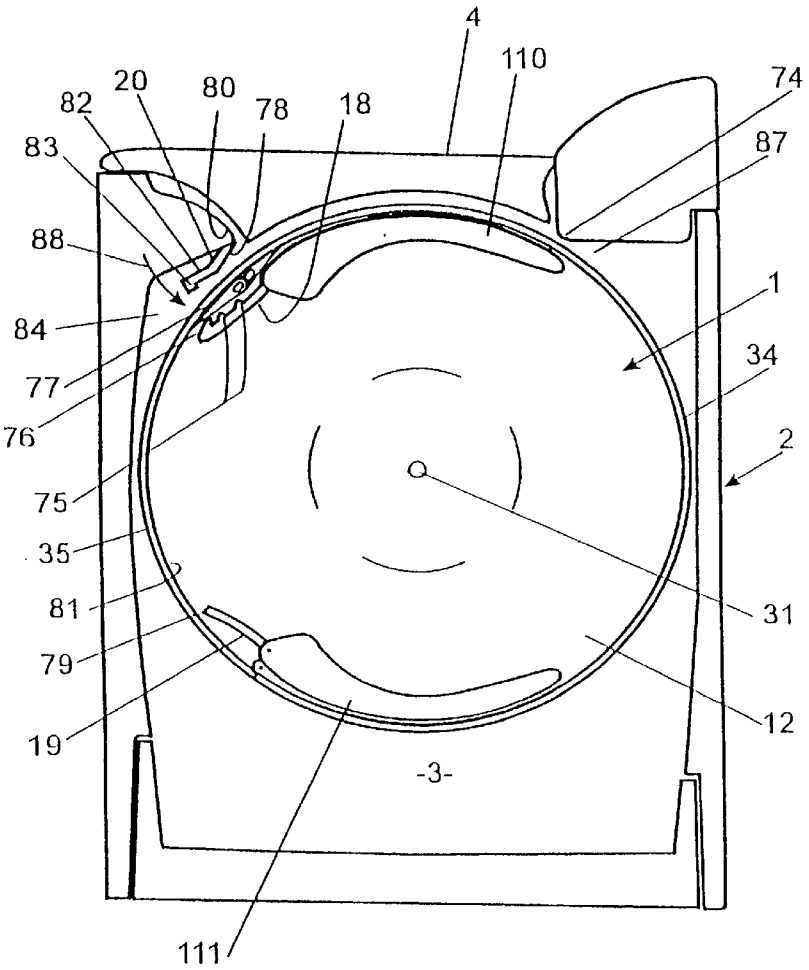

FIGS. 3A to 3E demonstrate the sequence of operations involved in opening the drum. The drum 1 is first rotated to the opening position as depicted in FIG. 3A where the series of protrusions 83 of the hatch engaging flap 20 can engage in the corresponding openings 84 in the outer face 85 of the looped over edge 36 of the hatch 35. The microprocessor energises the electrical linear actuator to rotate the flap 20 down as indicated by the arrow 88. Rotating the flap 20 down causes the protrusions to engage in the openings 84 in the looped over edge 36 of the hatch 35. This condition is shown in FIG. 3B. The electrical linear actuator holds the flap 20 in the engaged position throughout the drum opening and closing operations and while the drum 1 is open. It only returns the flap 20 to its disengaged position once the drum 1 has been completely closed and latched shut once more.

With the hatch section 35 of the drum skin 22 engaged by the hatch engaging flap 20 as depicted in FIG. 3B, the active latch connecting the looped over edge 36 of the hatch 35 and the corresponding edge 38 of the main section 34 is released. This is done in the manner described earlier with reference to FIGS. 4A and 4B, by automatedly sliding the protruding button 64 of the slide bar 40 from the "closed" position to the "open" position.

Figure 3D:
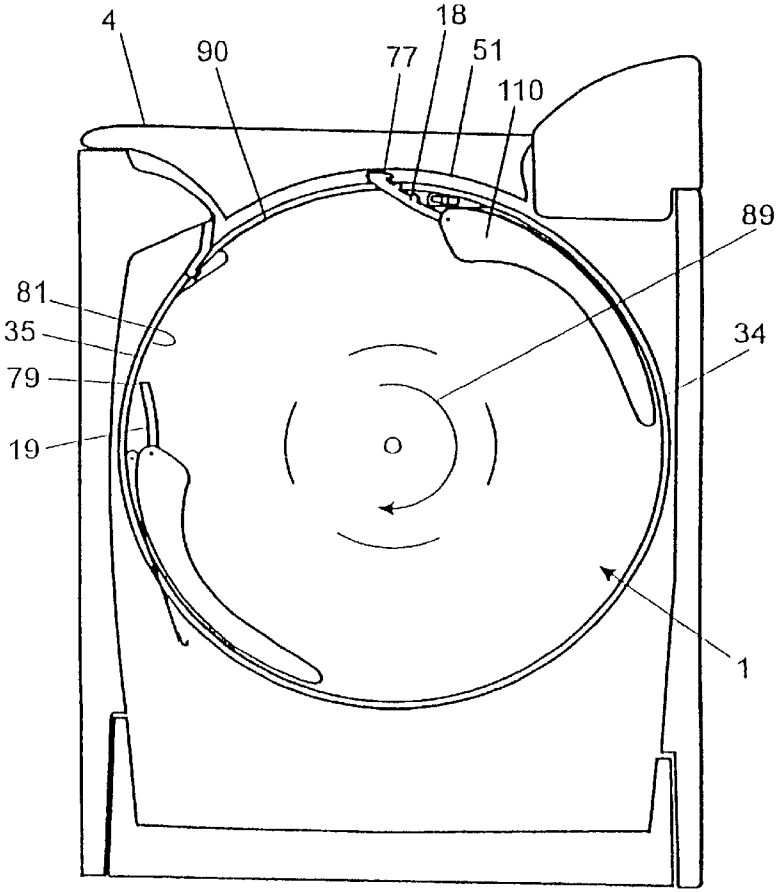
Figure 3C:
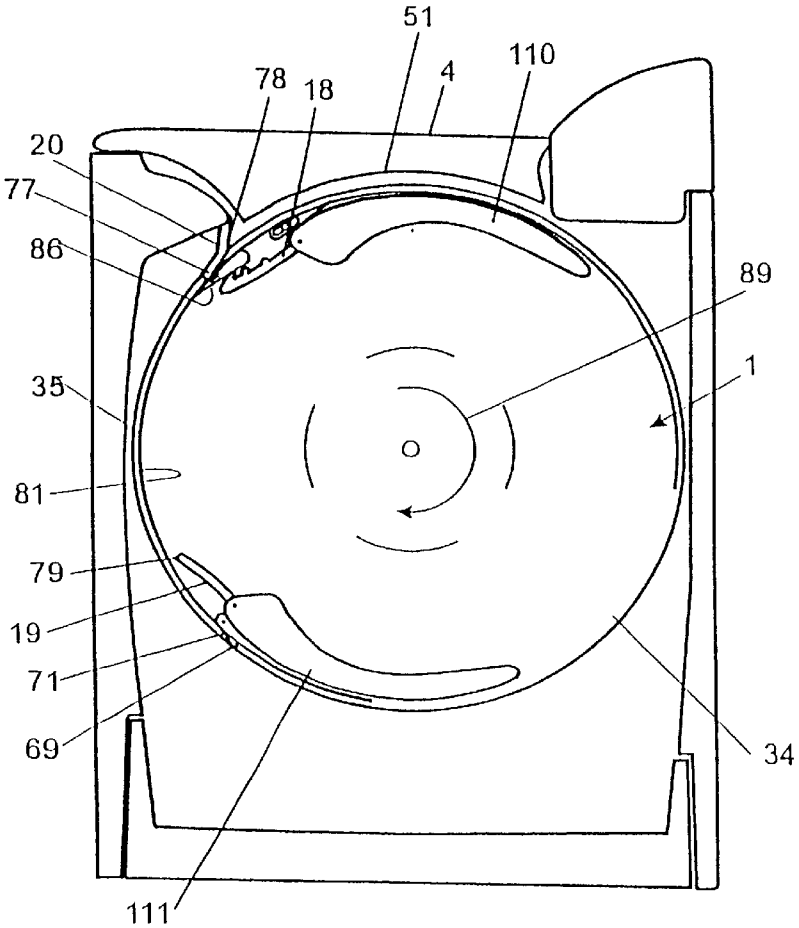
Figure 3F:
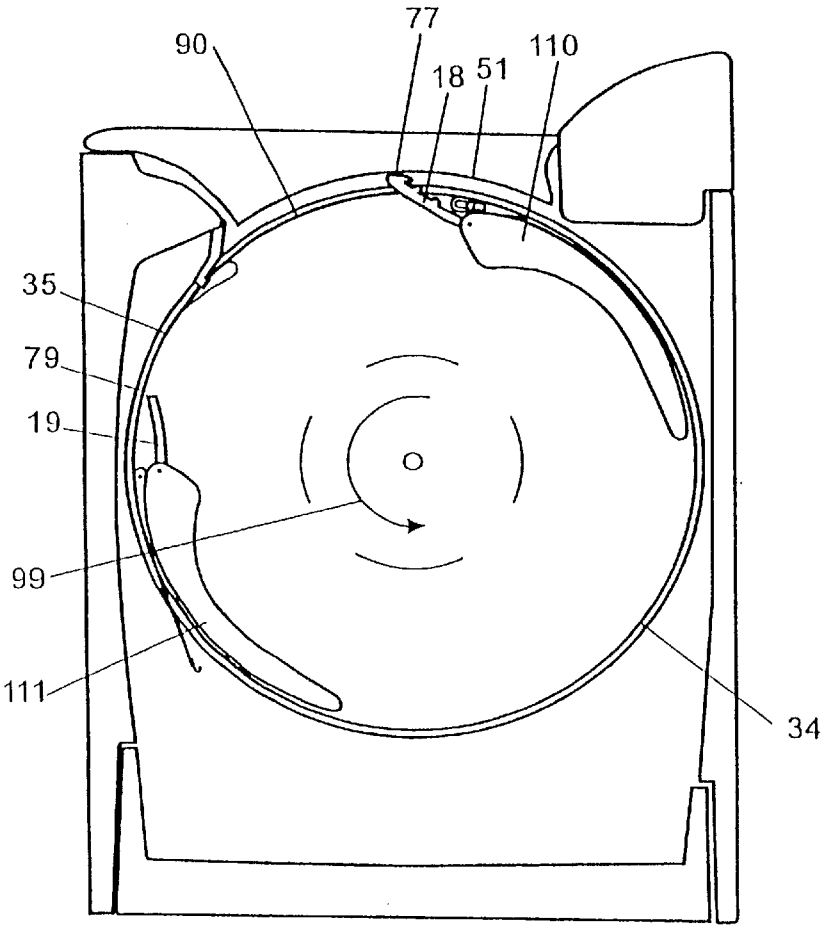
Figure 3E:
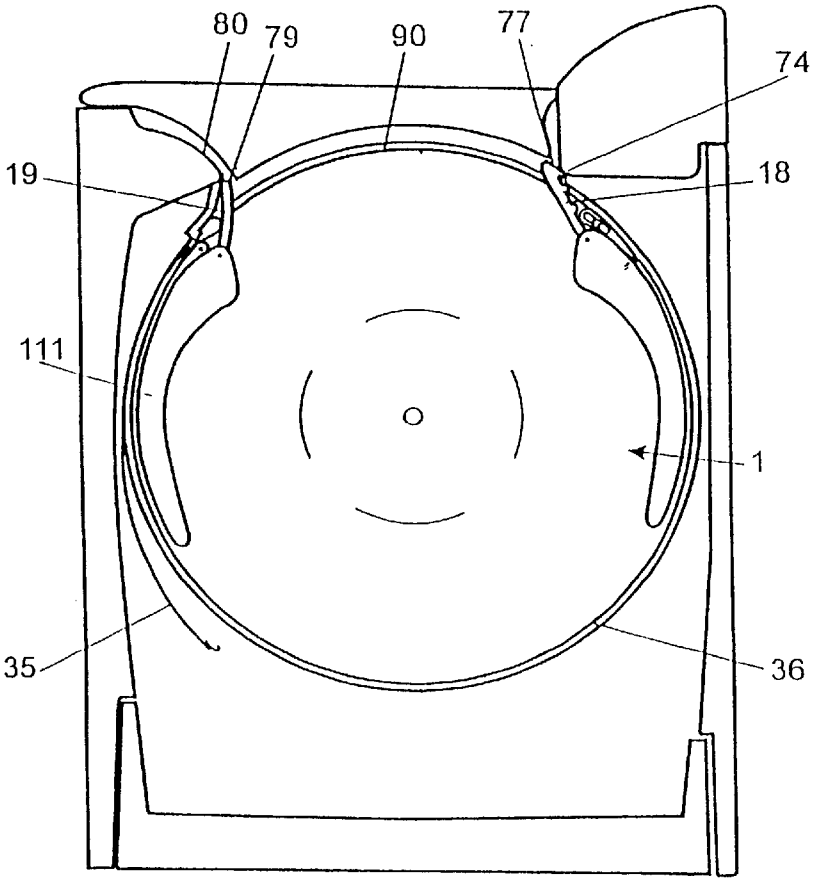

With the active latch disengaged the drum is now slowly rotated in the direction as indicated by arrow 89 in FIG. 3B. The drum is shown at different stages of the opening rotation in FIGS. 3C to 3E. FIG. 3C shows the drum in a position where the rotation in the direction of the arrow 89 has just begun. FIG. 3D shows the drum in a position where the rotation in the direction of the arrow 89 has further progressed FIG. 3E shows the drum in a position where the opening rotation is complete and the drum is stationary.

The passive latch connecting the edge 37 of the hatch section 35 and the edge 39 of main section 34 (described in detail earlier with reference to FIGS. 5A and 5B) disengages automatically by the relative rotation of the hatch section 35 and the main drum section 34. Note that the path of the hatch section 35, at least in the region between the vanes 110, 111 of the drum 1, is guided by channels 90 in the drum ends 11,12 within which the edges 15 of the hatch section 35 slide. These channels 90 are set to give the closed hatch section very nearly the same curvature and circular path as the main drum section 34, and guide the edges 36, 37 of the hatch section 35 to meet the corresponding edges 38, 39 of the main section 34 when the drum is closed.

In the opening rotation the first clothes guiding flap 18 (connected to the vane 110 that will form the rearward side of the opening into the drum), under the bias of its spring, is dragged over the inside surface 81 of the hatch section 35 for a short distance, before leaving the hatch section surface and passing over the ramp face 78 of the hatch engaging flap 20 to the inside surface 51 of the lid 4. It is dragged across the inside surface 51 of the lid 4 to the point where that surface meets the lower front edge 74 of the console module 21. It meets this edge 74 and rests against it substantially at the point where the hatch 35 is fully open and the drum 1 can be said to be in its open position.

Meanwhile the second flap 19 (the flap extending from the edge 53 of the vane 111 that forms the front side of the drum opening), under the bias of its spring, scrapes along the inside surface 81 of the hatch section 35 of the drum skin 22 as the drum 1 is rotated to the open position. In so doing, the leading edge 79 of the flap 19 peels the damp laundry load away from the drum skin to fall within the body of the drum. As the drum 1 nears the fully open position the second flap 19 passes over the looped over region 86 of the hatch section 35 and rotates outward due to the spring, to have its leading edge 79 sit against the front edge 80 of the cabinet opening (as shown in FIG. 3E).

Closing the Drum

Figure 3H:
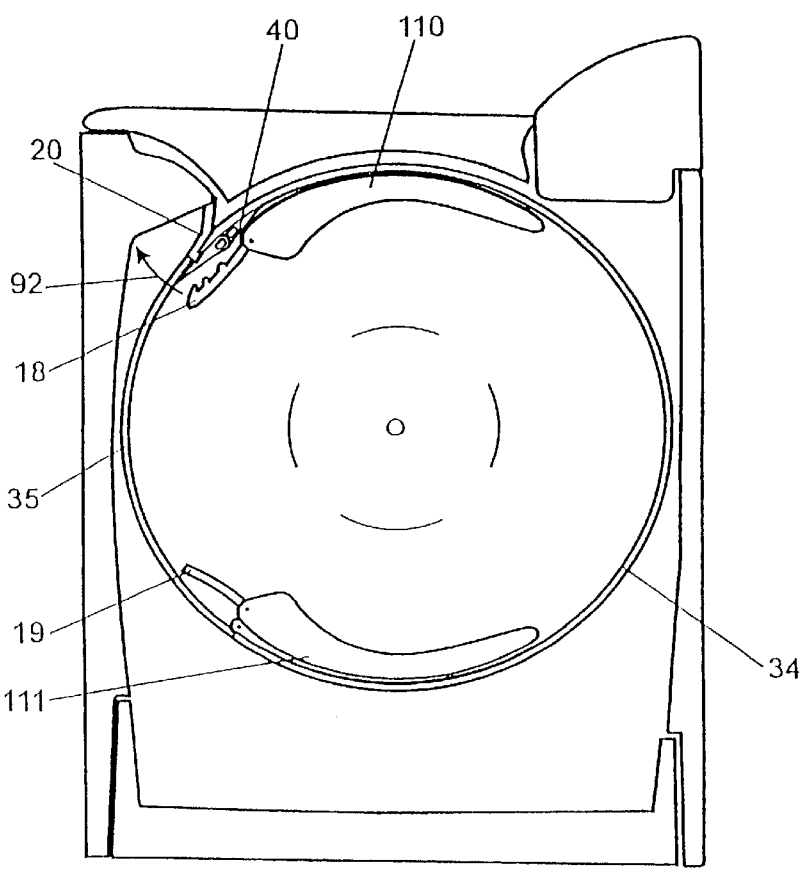
Figure 3G:
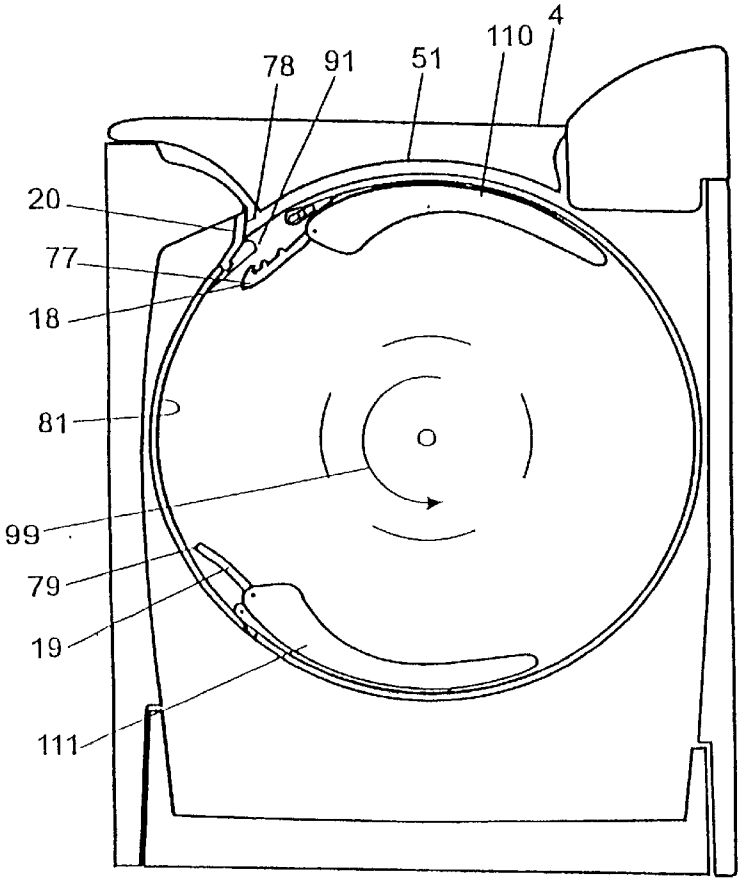
Figure 3I:
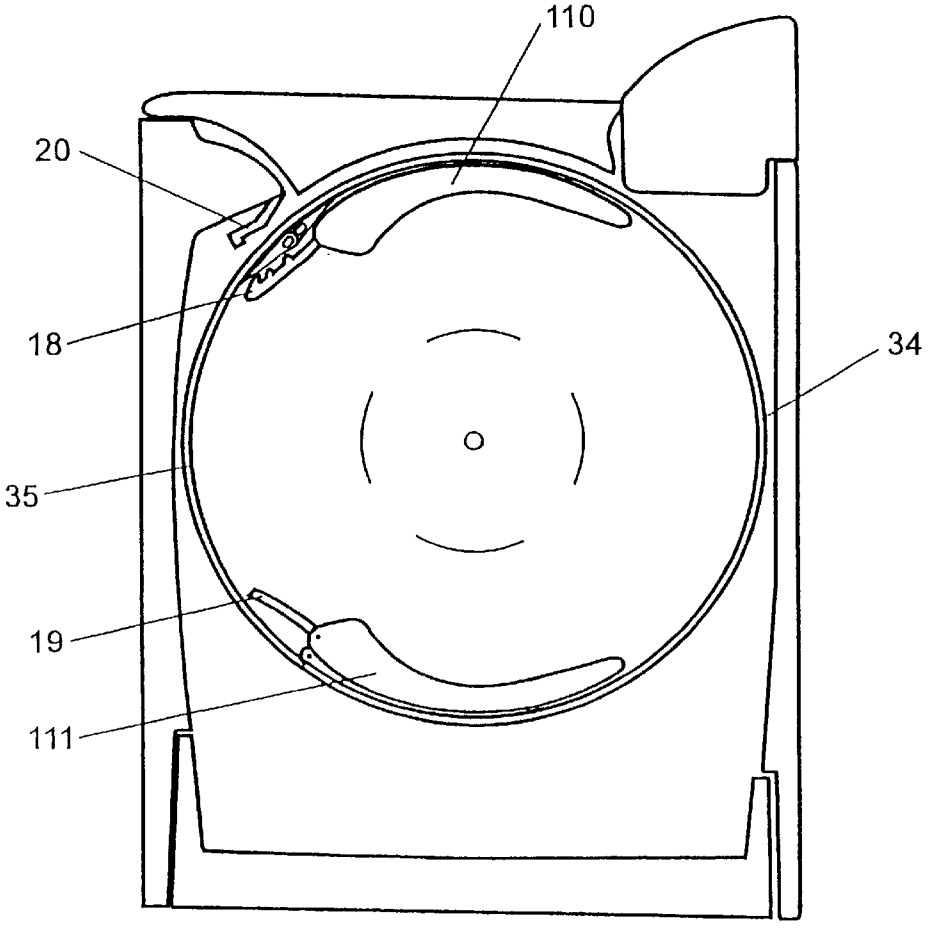

Closing the drum basically is the reverse process of opening the drum. FIGS. 3E to 3J demonstrate the sequence of operations involved in closing the drum. The lid 4 is firstly locked. Then the drum 1 is rotated closed in the direction indicated by the arrow 90. The drum is shown at different stages of the closing rotation in FIGS. 3F to 3H. FIG. 3F shows the drum in a position where the rotation in the direction of the arrow 90 has just begun. FIG. 3G shows the drum in a position where the rotation in the direction of the arrow 90 has further progressed. FIG. 3H shows the drum in a position where the closing rotation is complete and the drum is stationary.

In the closing rotation the first laundry guiding flap 18, under the bias of its spring, is pushed back along the inner surface 51 of the lid 4. The flap 18 passes between any laundry that happens to be above the level of the drum opening and the lid surface 51 and collects that laundry into the drum as it goes. Having been pushed across the inside surface 51 of the lid 4 the first flap 18 meets the ramp face 78 of the hatch engaging flap 20 and passes therealong. It then meets the leading end 91 of the looped over edge 36 of the hatch section 35, at a point below centre, and is guided to the inside of the hatch section 35. This careful design of the surfaces of the foot 77 of the first flap 18, the inside 51 of the lid 4, and the ramp face 78 of the hatch engaging flap 20 to ensure that the abutment of the surfaces always guides the first flap 18 in the correct direction. An alternative embodiment of the flaps is described below with reference to FIGS. 6A and 6B. That embodiment does not require quite such careful surface design and instead relies on the second flap 19 being replaced by a combination of two flaps, one of which is an active flap hinged from the cabinet. Due to the need for the additional actuation of the active flap that embodiment is less preferable than the present.

The second flap 19 (the flap extending from the edge 53 of the vane 111 that forms the front side of the drum opening), is dragged back onto the inside surface 81 of the hatch section 35 and along that surface 81 by the relative rotation between the vane 111 and the hatch section 35. The flap 19 remains biased against that surface by its As the drum 1 completes its closing rotation, as in FIG. 3H, at the active connection the loops 57 along the edge 38 of the drum main section 34 pass into the spaces between the loops 58 along the edge 36 of the hatch section 35. Simultaneously, at the passive connection, the spaced apart hooks 69 of the hatch section 35 engage the rod 71 retained within the loops 70 of the main section edge 39.

At the active connection, with the loops 57, 58 of the drum main section 34 and the drum hatch section 35 fully interleaved the active connection is made by sliding the protruding button 64 of the slide bar 40 from the "open" position to die "closed" position.

With the drum 1 now fully closed and latched shut the hatch engaging flap 20 is actuated by the electrical actuator to be rotated in the direction of the arrow 92 (see FIG. 3J) into its disengaged position as shown in FIG. 3J.

Alternative Flap Embodiment

As indicated above, in an alternative embodiment the second flap 19 may be replaced by a combination of a small passive flap 93 on the edge 53 of the vane 111 and a larger actively controlled flap 94 hinged from the cabinet 2 of the machine adjacent the front edge 80 of the opening. This embodiment is depicted in FIGS. 6A and 6B which show the drum 1 fully open and in the last stages of closing respectively.

Figure 6B:
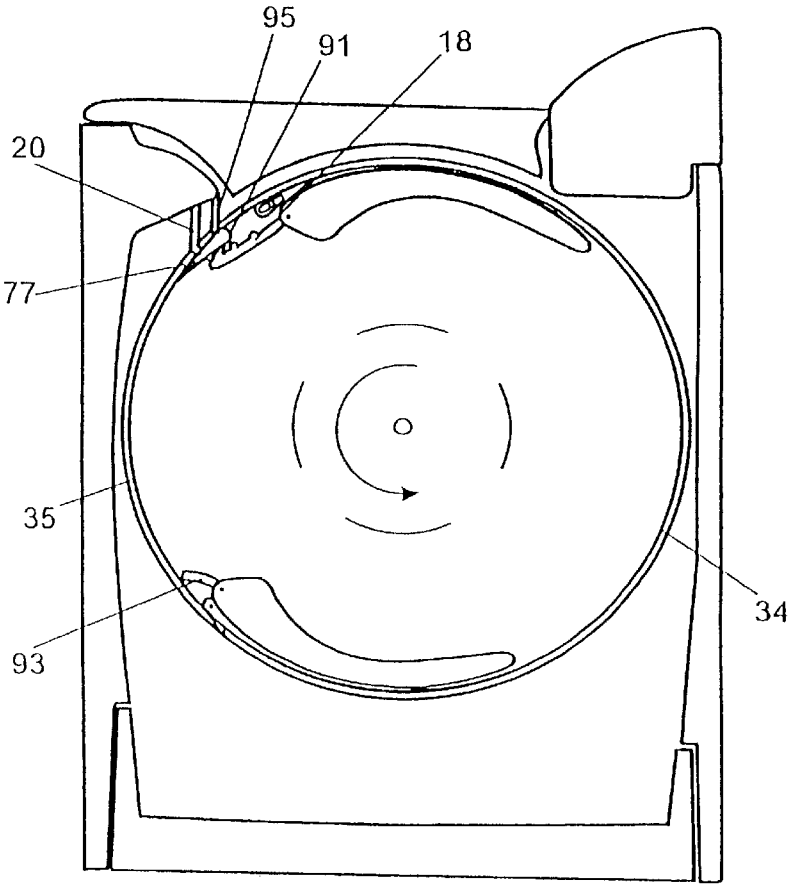
FIGS. 6A and 6B are cross sectional side elevations in simplified form showing an alternative arrangement of laundry guiding flaps to that shown in FIGS. 3A to 3G, and demonstrate their operation.
Figure 6A:
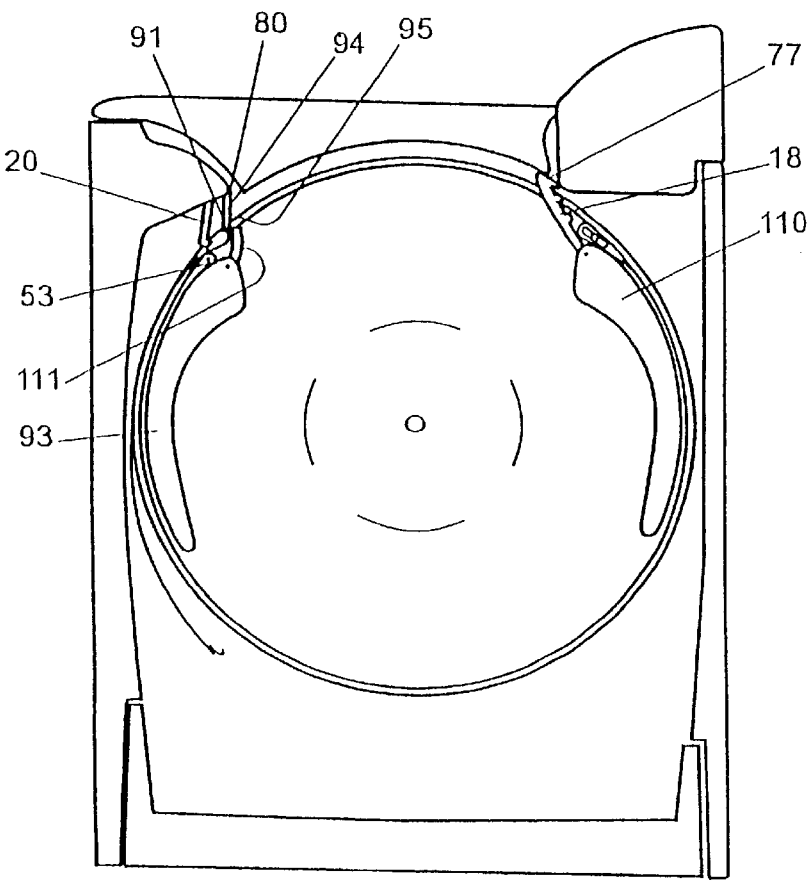

It can be seen in FIG. 6A that with the drum 1 fully open, the small flap 93 on the vane 111 (which still acts as the damp clothes scraper during the opening rotation) extends over the looped over edge 36 of the batch section 35, while the larger active flap 94 extends to a position just above the leading edge 91 of the hatch section 35, and is overlapped by the small flap 93.

As illustrated in FIG. 6B, when closing the drum 1, the first flap 18 is guided to meet the leading edge 91 of the hatch section 35 below the centre of the loops 58 by the leading face 95 of the active flap 94 (acting as the ramp face 78 of the hatch engaging member 20 did in the embodiment described above). The first flap 18 is thus tucked inside the hatch section 35 during the closing rotation.

The active flap can be rotated into and out of position in conjunction with the hatch engaging member 20 (which in the present embodiment takes a simpler shape) and for that purpose may be linked thereto to rotate in parallel therewith.

ADVANTAGES

From the above it can be seen that the invention provides a horizontal axis washing machine that has similar ergonomic and convenience advantages as existing vertical axis top loading washing machines. Furthermore the layout and operation of the machine will be familiar to the user. In addition the user is only required to open the lid of the machine and the contents of the drum are automatically presented to the user without further opening of doors or drums being required. The opening and closing of the drum is accomplished without user intervention, and the system of flaps and vanes prevents portions of the wash load from becoming jammed in the lid or hatch mechanism.

In addition to the above features which are of considerable benefit to the user, the present invention also provides a drum construction which retains the inherent strength and integrity of a continuous hoop even though it has an access opening provided directly therethrough. The construction allows the machine to have a large (full width) access opening together with a high spin speed.

What is claimed is:

1. A method of operating a horizontal axis laundry machine through a drum opening operation, said laundry machine including a cabinet, a drum mounted in the cabinet and having a drum skin comprising a cover section and a remaining section, an edge of the cover section connected to an edge of the remaining section by an interengaging latch member, said method comprising rotating the drum until the drum skin is in a first set position relative to the cabinet, engaging said cover section of said drum skin to retain the position thereof relative to said cabinet while engaged, sliding said latch member to release said cover section edge from said remaining section edge, rotating said drum to a second set position with said cover section engaged to leave an opening into said drum, and allowing opening of said cabinet to provide access to said opening.

2. A laundry machine incorporating a control system adapted to perform the method of claim 1.

3. A method of operating a horizontal axis laundry machine including a cabinet, a drum mounted in the cabinet and a hingingly supported laundry guide flap, said drum having a drum skin comprising a cover section and a remaining section, said method including the steps of:

rotating the drum until the drum skin is in a first set position relative to the cabinet, engaging a cover section of said drum skin to retain the position thereof relative to said cabinet while engaged, rotating said drum to a second set position with said cover section engaged to leave an opening into said drum, hinging said laundry guide flap to a position inhibiting access between said drum and said cabinet adjacent said opening, and allowing opening of said cabinet to provide access to said opening.

4. A method of operating the horizontal axis laundry machine as claimed in claim 3 wherein said laundry machine includes a second laundry guide flap hingingly supported opposite to said first laundry guide flap, and said method includes the step of hinging said second laundry guide flap to a position to inhibit laundry incursion between said drum and said cabinet adjacent said opening and opposite said first laundry guide flap.

5. A method of operating a horizontal axis laundry machine as claimed in claim 4 wherein each said guide flap is hingingly connected within said drum and biased to hinge outward toward said cover section and said step of hinging each said guide flap into said access inhibiting position is performed by said bias once said flap is advanced clear of said cover section by said rotation of said drum.

6. A method of operating a horizontal axis laundry machine as claimed in claim 3 wherein said guide flap is hingingly connected within said drum and biased to hinge outward toward said cover section and said step of hinging said guide flap into said access inhibiting position is performed by said bias once said flap is advanced clear of said cover section by said rotation of said drum.

* * * * *